US009089459B2

(12) United States Patent
Dindas et al.

(10) Patent No.: US 9,089,459 B2
(45) Date of Patent: Jul. 28, 2015

(54) PERSON SUPPORT APPARATUS

(71) Applicant: Völker GmbH, Witten (DE)

(72) Inventors: Martin Dindas, Hattingen (DE); Ronny Diekmann, Recklinghausen (DE); Andreas Pietsch, Duelmen (DE); Guenther Dorenbeck, Kaarst (DE)

(73) Assignee: Völker GmbH, Witten (DE)

( * ) Notice: Subject to any disclaimer, the term of this patent is extended or adjusted under 35 U.S.C. 154(b) by 0 days.

(21) Appl. No.: 14/540,185

(22) Filed: Nov. 13, 2014

(65) Prior Publication Data

US 2015/0135431 A1 May 21, 2015

(30) Foreign Application Priority Data

Nov. 18, 2013 (EP) ..... 13193375

(51) Int. Cl.
*A61G 1/00* (2006.01)
*A61G 7/012* (2006.01)
(Continued)

(52) U.S. Cl.
CPC ..... *A61G 7/012* (2013.01); *A61G 1/0237* (2013.01); *A61G 1/0287* (2013.01); *A61G 2007/0528* (2013.01)

(58) Field of Classification Search
CPC ..... A61G 1/00; A61G 7/012
USPC ..... 5/11, 611, 86.1
See application file for complete search history.

(56) References Cited

U.S. PATENT DOCUMENTS 585,834 A 7/1897 Ruth
595,734 A 12/1897 Rand et al.
598,054 A 1/1898 Meany
(Continued)

FOREIGN PATENT DOCUMENTS

DE 23106030 3/1973
DE 43 20 092 12/1993
(Continued)

OTHER PUBLICATIONS

"Impression" Brochure, Kinetic Concepts, Inc., Aug. 1996.
(Continued)

*Primary Examiner* — Frederick Conley
(74) *Attorney, Agent, or Firm* — Barnes & Thornburg LLP

(57) ABSTRACT

A patient support apparatus includes a patient support frame for supporting a patient support deck, the patient support frame having two sides extending between a head end and a foot end, and a support assembly for supporting the patient support frame and moving it relative to a floor surface. The support assembly comprises two leg assemblies pivotally coupled at their first upper end portions to the patient support frame and coupled at their lower end portion to floor engaging means. The sides of the patient support frame each comprise inverted substantially U-shaped channel elements having a substantially continuous upper surface, two substantially continuous side surfaces connected at their top edges to the upper surface, and a downward facing opening between the bottom edges of the two side surfaces. The first upper end portion of the leg assemblies each include roller assemblies arranged to run inside the channel elements and engage and run along a channel between the bottom of the upper surface of the respective channel element and the bottom of the channel element.

11 Claims, 10 Drawing Sheets

(51) Int. Cl.
*A61G 1/02* (2006.01)
*A61G 7/05* (2006.01)

(56) References Cited

U.S. PATENT DOCUMENTS 1,017,153 A 2/1912 Kampe
1,043,370 A 11/1912 Stubbs
1,261,040 A 4/1918 Lanes
1,398,203 A 11/1921 Schmidt
1,440,783 A 1/1923 Kiley
2,245,909 A 6/1941 Enfiajian
2,281,209 A 4/1942 Smith
2,452,366 A 10/1948 Frenad
2,477,400 A 7/1949 Beem et al.
2,500,742 A 3/1950 Taylor
2,556,591 A 6/1951 Loxley
2,564,083 A 8/1951 Stachert
2,605,151 A 7/1952 Shampaine
2,687,536 A 8/1954 Miller
2,719,769 A 10/1955 Murphy
2,722,017 A 11/1955 Burst et al.
2,734,104 A 2/1956 Gollhofer
2,766,463 A 10/1956 Bendersky
2,869,614 A 1/1959 Wamsky
3,003,160 A 10/1961 Goodman
3,010,121 A 11/1961 Breach
3,036,314 A 5/1962 Wetzler
3,053,568 A 9/1962 Miller
3,099,440 A 7/1963 Burzlaff
3,112,500 A 12/1963 MacDonald
3,138,805 A 6/1964 Piazza
3,195,151 A 7/1965 Boyer
3,210,779 A 10/1965 Herbold
3,220,021 A 11/1965 Nelson
3,220,022 A 11/1965 Nelson
3,233,255 A 2/1966 Propst
3,239,853 A 3/1966 MacDonald
3,277,501 A 10/1966 Frisz et al.
3,309,717 A 3/1967 Black
3,317,931 A 5/1967 Benoit et al.
3,393,004 A 7/1968 Williams
3,406,772 A 10/1968 Ahrent et al.
3,456,269 A 7/1969 Goodman
3,506,989 A 4/1970 Ross et al.
3,526,008 A 9/1970 Pruim
3,585,659 A 6/1971 Burst et al.
3,593,350 A 7/1971 Knight et al.
3,598,947 A 8/1971 Osborn
3,611,452 A * 10/1971 Turko et al. ..... 5/610
3,640,566 A 2/1972 Hodge
3,663,772 A 5/1972 Grabel
3,665,528 A 5/1972 Kjellberg et al.
3,724,003 A 4/1973 Ellwanger et al.
3,814,414 A 6/1974 Chapa
3,822,425 A 7/1974 Scaler
3,845,947 A 11/1974 Lee
3,893,197 A 7/1975 Ricke
3,897,973 A 8/1975 Long et al.
3,902,204 A 9/1975 Lee
3,905,591 A 9/1975 Schorr et al.
3,916,461 A 11/1975 Kersthok
3,932,903 A 1/1976 Adams et al.
3,977,664 A 8/1976 Mitchell et al.
3,993,051 A 11/1976 Maruyama
4,016,613 A 4/1977 Benoit et al.
4,038,709 A 8/1977 Kerwit
4,062,075 A 12/1977 Stern et al.
4,078,269 A 3/1978 Weipert
4,103,376 A 8/1978 Benoit et al.
4,127,906 A 12/1978 Zur
4,139,917 A 2/1979 Fenwick
4,150,269 A 4/1979 Henkel
4,168,099 A 9/1979 Jacobs et al.
4,183,109 A 1/1980 Howell
4,193,149 A 3/1980 Welch
4,195,829 A 4/1980 Reser
4,205,665 A 6/1980 Burton
4,225,989 A 10/1980 Corbett et al.
4,231,030 A 10/1980 Weiss
4,231,124 A 11/1980 Croxton
4,240,169 A 12/1980 Roos
4,258,445 A 3/1981 Zur
4,259,762 A 4/1981 Civitelli
4,293,746 A 10/1981 Braaten
4,312,500 A 1/1982 Janssen
4,336,621 A 6/1982 Schwartz et al.
4,345,344 A 8/1982 Gadoury et al.
4,354,838 A 10/1982 Hoyer et al.
4,361,917 A 12/1982 Wilson
4,369,535 A 1/1983 Ekkerink
4,386,254 A 5/1983 Eberhardt et al.
4,409,695 A 10/1983 Johnston et al.
4,411,035 A 10/1983 Fenwick
4,425,673 A 1/1984 Werner
4,435,862 A 3/1984 King et al.
4,453,732 A 6/1984 Assanah et al.
4,472,845 A 9/1984 Chivetta et al.
4,494,259 A 1/1985 Miller et al.
4,539,560 A 9/1985 Fleck et al.
4,542,547 A 9/1985 Sato
4,545,084 A 10/1985 Peterson
4,557,471 A 12/1985 Pazzini
4,586,492 A 5/1986 Manahan
4,612,679 A 9/1986 Mitchell
4,625,345 A 12/1986 Wood
4,638,516 A 1/1987 Vrzalik
4,653,129 A 3/1987 Kuck et al.
4,654,903 A 4/1987 Chubb et al.
4,675,926 A 6/1987 Lindblom et al.
4,680,790 A 7/1987 Packard et al.
4,685,159 A 8/1987 Oetiker
4,724,555 A 2/1988 Poehner et al.
4,745,647 A 5/1988 Goodwin
4,751,754 A 6/1988 Bailey et al.
4,768,249 A 9/1988 Goodwin
4,769,584 A 9/1988 Irigoyen et al.
4,797,962 A 1/1989 Goode
4,811,435 A 3/1989 Foster et al.
4,821,470 A 4/1989 Kappers et al.
4,847,929 A 7/1989 Pupovic
4,851,625 A 7/1989 Liebich
4,856,123 A 8/1989 Henderson et al.
4,858,260 A 8/1989 Failor et al.
4,858,481 A 8/1989 Abraham
4,862,529 A 9/1989 Peck
4,862,530 A 9/1989 Chen
4,894,876 A 1/1990 Fenwick
4,912,787 A 4/1990 Bradcovich
4,944,055 A 7/1990 Shainfeld
4,949,410 A 8/1990 Failor et al.
4,951,032 A 8/1990 Langsam
4,953,243 A 9/1990 Birkmann
4,974,905 A 12/1990 Davis
4,985,946 A 1/1991 Foster et al.
5,015,024 A * 5/1991 Bloemer ..... 296/20
5,022,105 A * 6/1991 Catoe ..... 5/11
5,035,014 A 7/1991 Blanchard
5,040,253 A 8/1991 Cheng
5,054,141 A 10/1991 Foster et al.
5,060,425 A 10/1991 Kappers et al.
5,063,624 A 11/1991 Smith et al.
5,072,463 A 12/1991 Willis
5,074,000 A 12/1991 Soltani et al.
5,077,843 A 1/1992 Dale et al.
5,083,332 A 1/1992 Foster et al.
5,083,334 A 1/1992 Huck et al.
5,095,561 A 3/1992 Green et al.
5,103,519 A 4/1992 Hasty
5,105,486 A 4/1992 Peterson
5,109,554 A 5/1992 Borders et al.
5,117,521 A 6/1992 Foster et al.
5,127,034 A 6/1992 Wright
5,129,117 A 7/1992 Celestina et al.
5,148,562 A 9/1992 Borders et al.

(56) References Cited

U.S. PATENT DOCUMENTS 5,157,787 A 10/1992 Donnellan et al.
5,157,800 A 10/1992 Borders
5,179,744 A 1/1993 Foster et al.
5,193,633 A 3/1993 Ezenwa
5,205,004 A 4/1993 Hayes et al.
D336,577 S 6/1993 Celestina et al.
5,216,769 A 6/1993 Eakin
5,224,228 A 7/1993 Larrimore
5,230,113 A 7/1993 Foster et al.
5,235,258 A 8/1993 Schuerch
5,235,713 A 8/1993 Guthrie et al.
5,267,364 A 12/1993 Volk
5,269,388 A 12/1993 Reichow et al.
5,279,010 A 1/1994 Ferrand et al.
5,283,096 A 2/1994 Greenberg et al.
5,305,482 A 4/1994 Dewert
5,317,769 A 6/1994 Weismiller et al.
5,323,565 A 6/1994 Kappers et al.
5,324,900 A 6/1994 Gonser et al.
5,348,326 A 9/1994 Fullenkamp et al.
5,367,728 A 11/1994 Chang
5,370,111 A 12/1994 Reeder et al.
5,394,580 A 3/1995 Foster et al.
5,398,354 A 3/1995 Balonick et al.
5,422,521 A 6/1995 Neer et al.
5,423,231 A 6/1995 Helfrich et al.
5,432,966 A * 7/1995 Berta et al. ..... 5/611
5,444,880 A 8/1995 Weismiller et al.
5,450,639 A 9/1995 Weismiller et al.
5,454,126 A 10/1995 Foster et al.
5,479,666 A 1/1996 Foster et al.
5,481,769 A 1/1996 Schneider
5,527,097 A 6/1996 Martin
5,537,701 A 7/1996 Elliott
5,542,136 A 8/1996 Tappel
5,542,138 A 8/1996 Williams et al.
5,577,279 A 11/1996 Foster et al.
5,579,550 A 12/1996 Bathrick et al.
5,608,932 A 3/1997 Hasegawa
5,611,094 A 3/1997 D'Entremont
5,630,238 A 5/1997 Weismiller et al.
5,636,394 A 6/1997 Bartley
5,653,064 A 8/1997 Kappers et al.
5,666,681 A 9/1997 Meyer et al.
5,687,437 A 11/1997 Goldsmith
5,689,839 A 11/1997 Laganiere et al.
5,701,618 A 12/1997 Brugger
5,715,548 A 2/1998 Weismiller et al.
5,720,059 A 2/1998 Allevato et al.
5,732,423 A 3/1998 Weismiller et al.
5,737,781 A 4/1998 Votel
5,745,937 A 5/1998 Weismiller et al.
5,749,123 A 5/1998 Warren et al.
5,771,511 A 6/1998 Kummer et al.
5,781,949 A 7/1998 Weismiller et al.
5,802,636 A 9/1998 Corbin et al.
5,802,640 A 9/1998 Ferrand et al.
5,806,111 A 9/1998 Heimbrock et al.
5,808,552 A 9/1998 Wiley et al.
5,873,137 A 2/1999 Yavets-Chen
5,878,452 A 3/1999 Brooke et al.
5,883,615 A 3/1999 Fago et al.
5,890,765 A 4/1999 LaPointe et al.
5,906,016 A 5/1999 Ferrand et al.
5,906,017 A 5/1999 Ferrand et al.
5,918,505 A 7/1999 Jensen
5,934,280 A 8/1999 Viard et al.
5,939,803 A 8/1999 Frost
5,987,671 A 11/1999 Heimbrock et al.
6,006,379 A 12/1999 Hensley
6,008,598 A 12/1999 Luff et al.
6,016,580 A 1/2000 Heimbrock et al.
6,021,533 A 2/2000 Ellis et al.
6,067,019 A 5/2000 Scott
6,076,208 A 6/2000 Heimbrock et al.
6,089,593 A 7/2000 Hanson et al.
6,131,868 A 10/2000 Welling et al.
6,158,295 A 12/2000 Nielsen
6,163,903 A 12/2000 Weismiller et al.
6,178,576 B1 1/2001 Newell
6,182,310 B1 2/2001 Weismiller et al.
6,185,767 B1 2/2001 Brooke et al.
6,208,250 B1 3/2001 Dixon et al.
6,212,714 B1 4/2001 Allen et al.
6,223,369 B1 5/2001 Maier et al.
6,226,821 B1 5/2001 Heimbrock et al.
6,240,583 B1 6/2001 Brooke et al.
6,260,221 B1 7/2001 Grabell et al.
6,276,011 B1 8/2001 Antinori
6,282,738 B1 9/2001 Heimbrock et al.
6,290,194 B1 9/2001 Chaconas et al.
6,295,675 B1 10/2001 Ellis et al.
6,321,878 B1 11/2001 Mobley et al.
6,336,235 B1 1/2002 Ruehl
6,351,678 B1 2/2002 Borders
6,353,950 B1 3/2002 Bartlett et al.
6,438,776 B2 8/2002 Ferrand et al.
6,473,921 B2 11/2002 Brooke et al.
6,484,221 B1 11/2002 Lorinser et al.
6,539,566 B1 4/2003 Hayes
6,559,783 B1 5/2003 Stoneking
6,601,251 B2 8/2003 Paul
6,606,670 B1 8/2003 Stoneking et al.
6,611,979 B2 9/2003 Welling et al.
6,629,247 B1 9/2003 Hall et al.
6,631,431 B1 10/2003 Silvkoff et al.
6,636,100 B1 10/2003 Shingaki
6,658,680 B2 12/2003 Osborne et al.
6,691,346 B2 2/2004 Osborne et al.
6,708,358 B2 3/2004 Hensley
6,735,797 B1 5/2004 Long et al.
6,751,688 B1 6/2004 El-Demerdash et al.
6,789,458 B2 9/2004 Schumacher et al.
6,912,594 B2 6/2005 Bartling
6,920,656 B2 7/2005 Roussy
6,944,739 B2 9/2005 Bartling et al.
6,957,461 B2 10/2005 Osborne et al.
6,976,357 B1 12/2005 Pfaff
6,978,500 B2 12/2005 Osborne et al.
7,009,995 B1 3/2006 Bohrer et al.
7,013,510 B1 3/2006 Johnson
7,028,352 B2 4/2006 Kramer et al.
7,076,517 B2 7/2006 Bartling
7,185,377 B2 3/2007 Roussy
7,296,312 B2 11/2007 Menkedick et al.
7,509,697 B2 3/2009 Dorenbeck
7,703,157 B2 4/2010 Dorenbeck
7,856,685 B2 * 12/2010 Matunaga et al. ..... 5/611
8,590,073 B2 11/2013 Bly et al.
8,800,080 B2 8/2014 Kay et al.
2001/0000828 A1 5/2001 Hensley
2001/0011393 A1 8/2001 Brooke et al.
2001/0011394 A1 8/2001 Heimbrock et al.
2001/0029628 A1 10/2001 Ferrand et al.
2001/0032362 A1 10/2001 Welling et al.
2001/0037724 A1 11/2001 Schumacher et al.
2002/0002742 A1 1/2002 Osborne et al.
2002/0013965 A1 2/2002 Wilson
2002/0014951 A1 2/2002 Kramer et al.
2002/0059679 A1 5/2002 Weismiller et al.
2002/0066142 A1 6/2002 Osborne et al.
2002/0080037 A1 6/2002 Dixon et al.
2002/0092096 A1 7/2002 Heimbrock et al.
2003/0051291 A1 3/2003 Brooke et al.
2003/0051292 A1 3/2003 Ferrand et al.
2003/0056016 A1 3/2003 Bartling
2003/0061547 A1 3/2003 Bartling
2003/0079603 A1 5/2003 Schumacher et al.
2003/0093860 A1 5/2003 Kramer
2003/0214953 A1 11/2003 El-Demerdash et al.
2004/0085903 A1 5/2004 Matsumoto et al.
2004/0128765 A1 7/2004 Osborne et al.
2004/0142722 A1 7/2004 Everett
2004/0143677 A1 7/2004 Novak

(56) References Cited

U.S. PATENT DOCUMENTS

| | | | |
|---|---|---|---|
| 2004/0151047 | A1 | 8/2004 | Bartling et al. |
| 2004/0153583 | A1 | 8/2004 | Bartling |
| 2004/0205111 | A1 | 10/2004 | Chasmawala et al. |
| 2005/0085710 | A1 | 4/2005 | Earnst et al. |
| 2005/0172405 | A1 | 8/2005 | Menkedick et al. |
| 2005/0273940 | A1 | 12/2005 | Petrosenko et al. |
| 2005/0284144 | A1 | 12/2005 | Pfaff |
| 2006/0053555 | A1 | 3/2006 | Poulos et al. |
| 2006/0053562 | A1 | 3/2006 | Poulos et al. |
| 2006/0059624 | A1 | 3/2006 | Poulos et al. |
| 2006/0075559 | A1 | 4/2006 | Skinner et al. |
| 2006/0075560 | A1 | 4/2006 | Osborne et al. |
| 2006/0096029 | A1 | 5/2006 | Osborne et al. |
| 2006/0101317 | A1 | 5/2006 | Uemura et al. |
| 2006/0162079 | A1 | 7/2006 | Menkedick et al. |
| 2006/0168730 | A1 | 8/2006 | Menkedick et al. |
| 2006/0168731 | A1 | 8/2006 | Menkedick et al. |
| 2006/0179579 | A1 | 8/2006 | Phillips et al. |
| 2006/0253982 | A1 | 11/2006 | Kummer et al. |
| 2007/0083992 | A1 | 4/2007 | Lindner et al. |
| 2007/0226907 | A1 | 10/2007 | Dorenbeck |

FOREIGN PATENT DOCUMENTS

| | | | |
|---|---|---|---|
| DE | 44 06 784 | | 8/1995 |
| DE | 199 00 602 | C1 | 7/2000 |
| DE | 199 15 431 | | 10/2000 |
| EP | 0 037 063 | A2 | 10/1981 |
| EP | 0 218 301 | A2 | 10/1986 |
| EP | 0 485 362 | A3 | 12/1986 |
| EP | 0 349 067 | B1 | 6/1989 |
| EP | 0 341 570 | A3 | 11/1989 |
| EP | 0 349 067 | A1 | 1/1990 |
| EP | 0 558 108 | A2 | 9/1993 |
| EP | 2 181 685 | B1 | 9/2003 |
| GB | 7095 | | 0/1913 |
| GB | 1 466 080 | | 3/1977 |
| GB | 2 015 872 | A | 10/1978 |
| GB | 2 169 195 | A | 7/1986 |
| GB | 2 313 303 | | 11/1997 |
| JP | 53-37515 | | 9/1978 |
| JP | 3-186212 | | 8/1991 |
| JP | 3-193005 | | 8/1991 |
| JP | 3-62422 | | 9/1991 |
| JP | 3-62423 | | 9/1991 |
| JP | 3-62424 | | 9/1991 |
| JP | 3-67698 | | 10/1991 |
| JP | 3-237976 | | 10/1991 |
| JP | 3-72304 | | 11/1991 |
| JP | 2512862 | | 4/1996 |
| JP | 2746295 | | 3/1998 |
| JP | 2825152 | | 9/1998 |
| WO | 98/17153 | | 4/1998 |
| WO | 99/15126 | | 4/1999 |
| WO | 00/07537 | | 2/2000 |
| WO | 00/69386 | | 11/2000 |
| WO | 01/47340 | | 7/2001 |
| WO | 01/62151 | | 8/2001 |
| WO | 03/079953 | | 10/2003 |
| WO | 03/088885 | | 10/2003 |
| WO | 2004/021952 | | 3/2004 |

OTHER PUBLICATIONS

Stryker Medical GO BED™ brochure, 2001 (2 pages).
Hill-Rom Med Surg Bed Accessories brochure, 1998 (6 pages).
European Patent Search, Application 13193375.6-1651, dated Sep. 10, 2014 (10 pages).

* cited by examiner

PERSON SUPPORT APPARATUS

CROSS-REFERENCE TO RELATED APPLICATIONS

The present application claims priority, under 35 U.S.C. §119(a), of European Application No. 13193375.6 which was filed Nov. 18, 2013 and which is hereby incorporated by reference herein.

BACKGROUND

The present disclosure relates to a person support apparatus, such as a bed and with a mechanism suitable for adjusting the height and orientation of a patient support frame forming part of that bed. It is more particularly suitable for a hospital or long-term care (LTC) bed.

Person support apparatus, such as hospital and long-term care beds, typically include a patient support deck and a support surface, such as a mattress, supported by the deck. The patient support deck may be controllably articulated so as to take up different support configurations.

The patient support deck is supported on a deck support or intermediate frame and the deck support frame is provided with a mechanism for adjusting the height of the deck and hence the height of the support surface above the floor on which the apparatus is located, and to control the orientation or inclination of the deck and hence the patient support surface relative to the floor. Adjustment of the height is helpful to allow care givers to access the patient, and to facilitate patient movement into and out of the bed. The inclination of the patient support surface is also desirable so as to make the patient more comfortable, or to, for example, take up the Trendelenburg position in which the body is laid flat on the back (supine position) with the feet higher than the head by 12-30 degrees, or the reverse Trendelenburg position, where the body is tilted in the opposite direction.

The deck support frame is supported on leg assemblies which are pivotally connected at their upper end to the deck support frame and which have linear actuators for pivoting the leg assemblies relative to the deck support frame and hence adjusting the height of the deck support frame. Separate and separately controllable head end and foot end leg assemblies are provided so that the height of the foot and head ends may be separately adjusted. The leg assemblies can be pivoted together by their respective actuators and thereby raise or lower the deck support frame whilst keeping it substantially parallel to the floor. Alternatively, one of the foot or head end assemblies can be pivoted to lower just one of the foot or head ends and thereby move the deck support frame into the Trendelenburg or reverse Trendelenburg positions.

Known arrangements for pivoting leg assemblies relative to a deck support frame to allow the raising and lowering of the deck support frame include a leg element pivotally connected at its upper end to a guide element which is coupled to and can slide along the outside of longitudinal elements arranged parallel to, or forming, the sides of the deck support frame. Those known arrangements comprise a U-shaped guide element arranged on its side (i.e. with its open side extending in a vertical direction) and arranged around the outside of longitudinal elements having a rectangular cross-section. Such arrangements suffer from a number of problems. These include: i) a risk of trapping fingers in the guide element which moves along the outside of the longitudinal elements: (ii) a need to overcome the frictional forces between the inner surface of the slideable guide element and the outer surface of the longitudinal element when pivoting the leg assembly and thereby sliding; and (iii) a propensity for dust and dirt to collect on the surface of the longitudinal element and hence interfere with the sliding operation.

US 2009/0094747 and US 2010/0050343 disclose alternative arrangements in which channels which correspond to U-shapes on their sides (i.e. with an open vertical side) are arranged on the sides of the intermediate or deck support frame and have follower or guide elements extending into the interior of the channels through the vertical open side. The follower or guide elements engage and run along an interior surface of the respective channels.

US 2006/0021143 discloses a further alternative arrangement in which guide tracks or channels are defined by slots extending through the vertical sides of longitudinal bed frame elements, and the upper end of the respective leg assemblies are provided with followers extending sideways out from the upper end of the leg assemblies to extend through or into the slots. The followers run along the guide tracks defined by the slots through the vertical sides of the bed frame elements.

A need exists for further contributions in this area of technology.

SUMMARY

An apparatus, system and/or method according to the present disclosure includes one or more of the features recited below or in the appended claims, and which alone, or in any combination, may define patentable subject matter:

The present disclosure, in a first aspect, provides a person support apparatus comprising: a person support frame for supporting a person support deck, the person support frame having two sides extending between a head end and a foot end; and a support assembly for supporting the person support frame and moving it relative to a floor surface, wherein the support assembly comprises at least one leg assembly pivotally coupled at a first upper end portion to the person support frame and coupled at its second lower end portion to floor engaging means, and an actuator element operable to move the leg assembly and thereby move the person support frame relative to the floor, wherein at least one of the sides of the person support frame comprises an inverted substantially U-shaped channel element having a substantially continuous upper surface, two substantially continuous side surfaces connected at their top edges to the upper surface, and a downward facing opening between the bottom edges of the two side surfaces, and the first upper end portion of the leg assembly includes a guide or follower element arranged to contact and run along an inner surface of the channel element.

This arrangement results in a deck support frame which is robust and stable and can accommodate the changes in geometry necessary for movement or adjustment between the horizontal, Trendelenburg and reverse Trendelenburg positions.

Some embodiments of the channel and roller mechanism change the height of a patient support deck by pivoting one or more leg assemblies relative to the under surface of the patient support frame.

Features of some illustrative embodiments include the following:

Some illustrative embodiments have a lower part count than known systems and are therefore likely to be both cheaper and more robust. More parts cost more to make and assemble and provide more elements capable of failure.

The opening of the channel carrying the guide elements or rollers faces the floor. This means that dirt is less likely to enter it and interfere with the mechanism. Furthermore, any dirt that enters will not be visible in normal use.

The leg assembly works vertically within the channel edges and a reduced force is therefore necessary to lift the patient support frame especially from the low position where the leg assemblies suspend a narrow angle relative to the underside of the patient support frame. The use of rollers in an optional embodiment rather than surfaces sliding relative to each other also reduces the frictional forces which must be overcome when moving the guide element. The use of a roller than a sliding element means that there is no need to overcome the friction between the sliding element and the frame element relative to which it slides thus reducing the force necessary to raise the deck support frame and makes the mechanism less likely to fail.

The use of a mechanism which includes a guide element inside a channel element means that the outside surface of the longitudinal channel element can be used as a fixing area for accessories or other elements.

Having the channel openly facing downwards and the guide element inside the channel make it harder for a patient or care-giver to trap their fingers or other body parts.

Features described in relation to one aspect and/or embodiment of the present disclosure may equally be applied to other embodiments and/or aspects of the present disclosure.

Additional features, which alone or in combination with any other feature(s), such as those listed above and/or those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

Illustrative embodiments will now be described in detail, by way of example only, with reference to the accompanying drawings, in which.

DETAILED DESCRIPTION

Hospital beds typically include a deck supporting a mattress or other patient support element (not shown in the Figs.). The deck may be divided into articulated sections so as to create various seating and lying down configurations. Articulated beds with a controllable articulation system for the patient support surface are known and are not a novel and inventive part of embodiments of the subject disclosure so will not be described in detail. An example of such an articulated patient support surface is shown in EP 2 181 685 and WO 2004/021952 to which reference should now be made and whose contents are hereby expressly incorporated herein by reference.

Figure 1A:
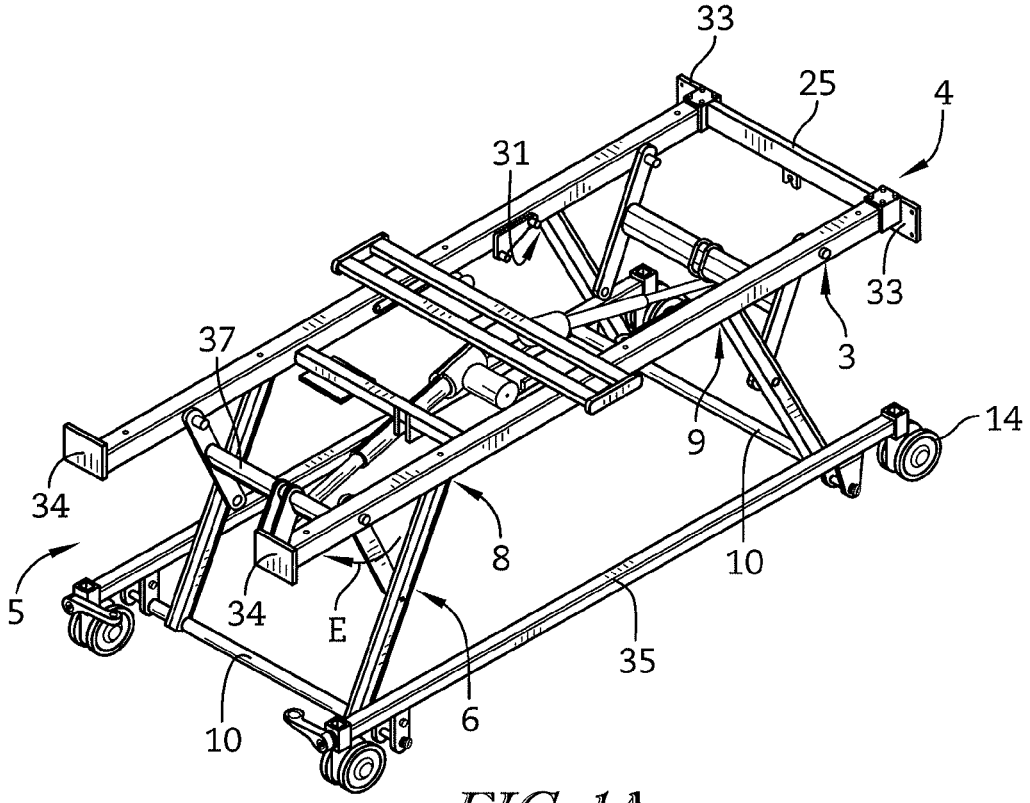
FIGS. 1*a* and 1*b* are isometric and perspective views from, respectively, the foot and head ends of a patient support apparatus including a deck support frame according to one embodiment of the present disclosure.
Figure 1B:
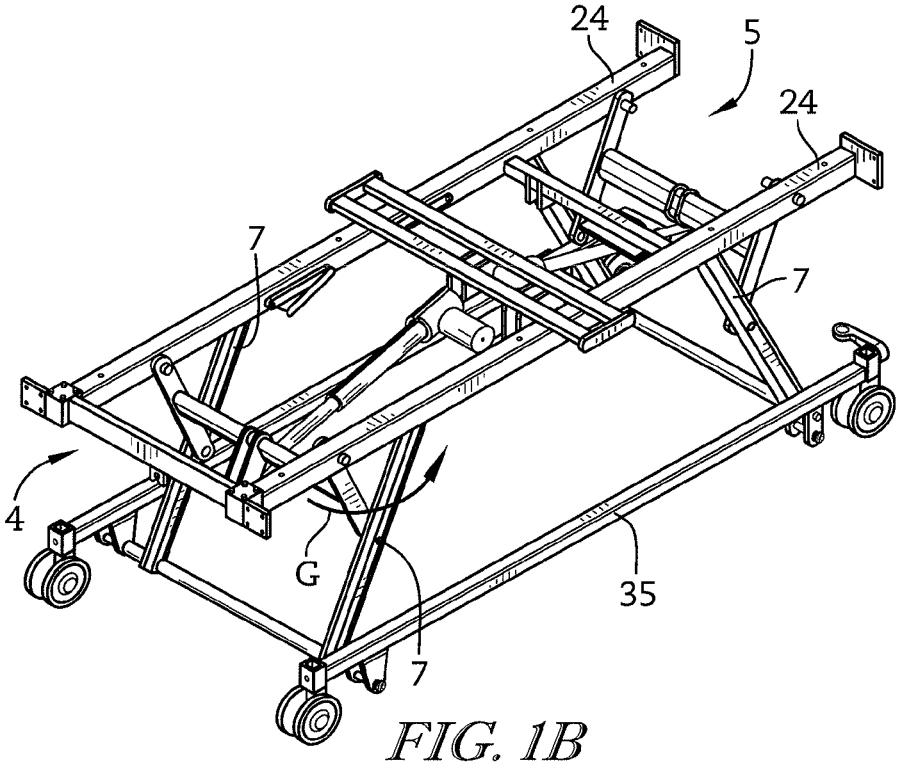
Figure 2:
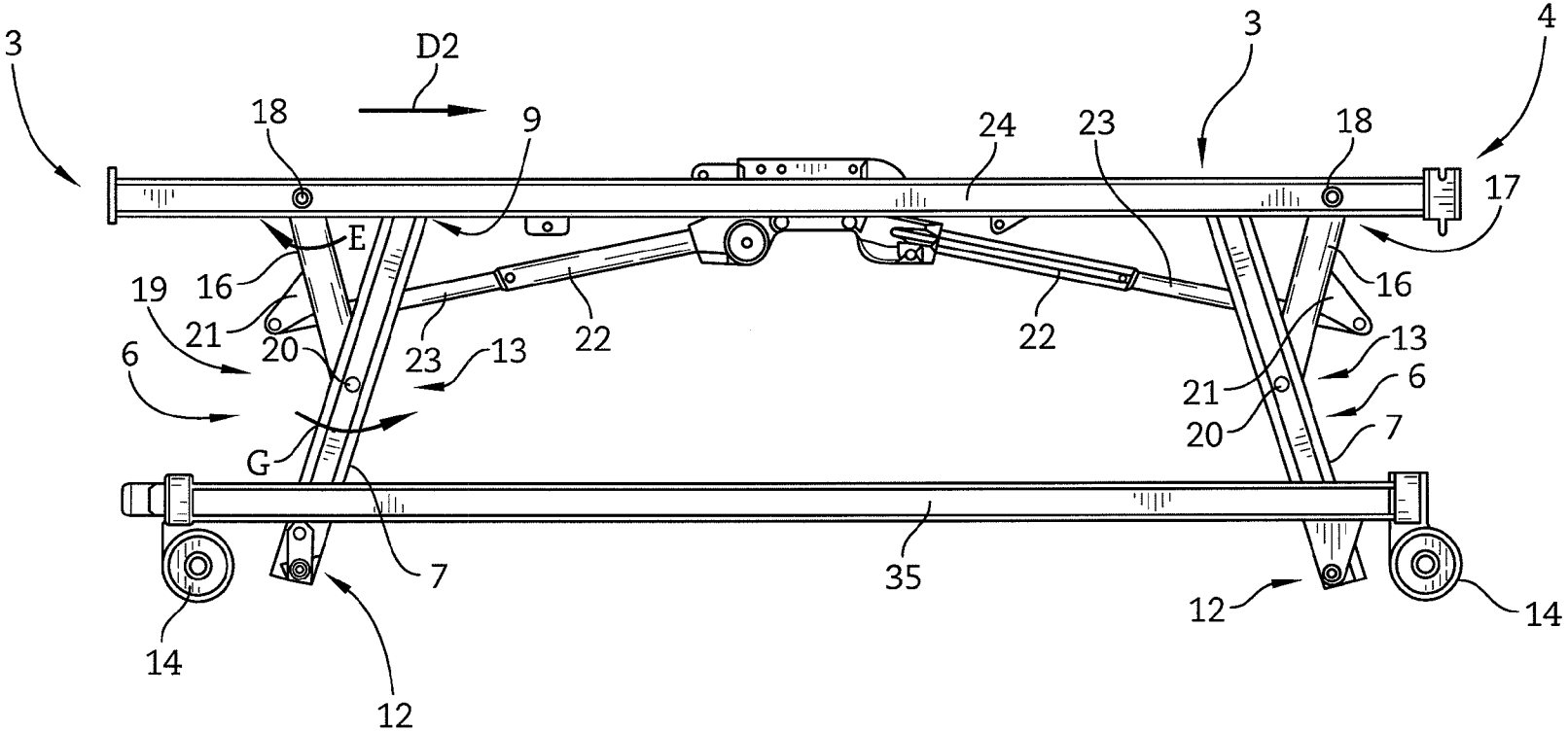
FIG. 2 is side view of the patient support apparatus of FIG. 1 with the patient support deck in a lowered position.
Figure 3:
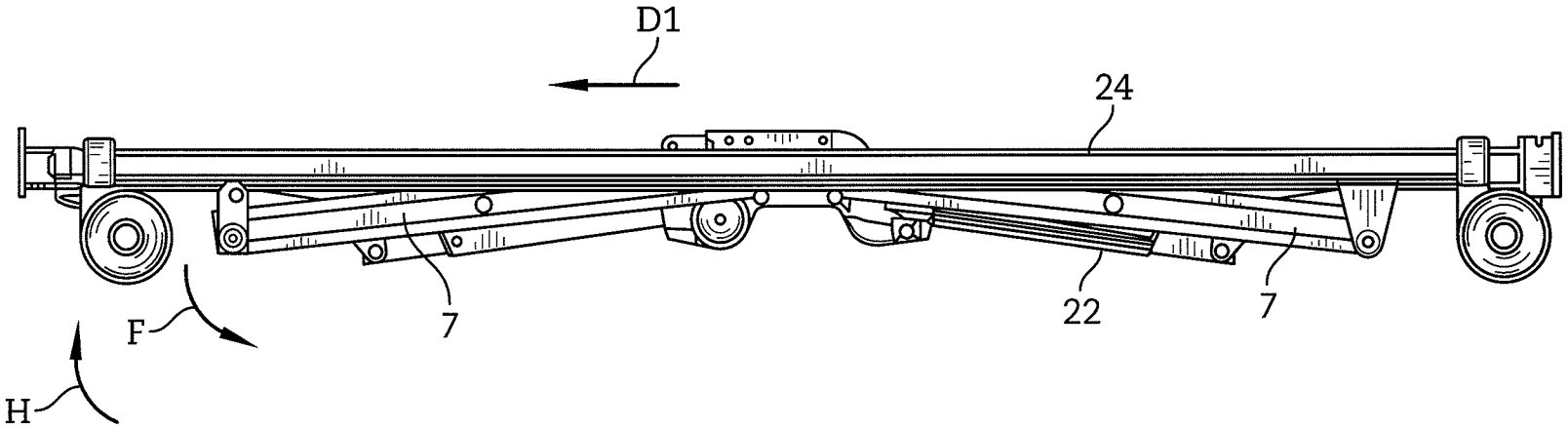
FIG. 3 is a view similar to that of FIG. 2 but with the patient support deck in a lowered position.

Referring to FIGS. 1 to 3, a hospital bed support assembly according to one embodiment of the present disclosure includes a deck support frame 3 to which a headboard and a footboard may be mounted at, respectively, its head 4 and foot 5 ends. The head board is mountable on head board plates 33 and the foot board on foot board plates 34. The deck support frame has two leg or support structures 6 pivotally mounted to its under surface. Each of the leg structures or assemblies 6 includes a pair of legs 7 each coupled to the deck support frame 3 by a moveable upper pivot or guide element 8 at their deck or upper end 9. The moveable upper guide elements can move parallel to the longitudinal axis of the deck frame. For example, the moveable upper guide element 8 of the left-hand leg in FIGS. 2 and 3 can move in the directions shown by arrows D1 and D2.

The lower portions of the legs 7 of each pair of legs are connected together by a lower bracing cross-element 10 at the bottom 12 of the legs. The lower cross-elements 10 are each in turn connected to a lower longitudinal or side element and able to rotate about their longitudinal axis. In the embodiment shown in FIGS. 1 to 3, each end of the foot end leg assembly lower cross-element is pivotally connected to a lower portion of a respective length extension element and the upper portion of each length extension element is pivotally connected to the lower longitudinal side element. The foot and head ends of the lower side elements 35 each have a castor or castor device 14 so that the support assembly can move over a floor or surface on which it is placed.

A pair of stabilizer elements 16 is connected to each pair of legs. A stabilizer element is connected to and links each leg to the underside of the deck support frame. The stabilizer elements 16, which are each coupled to a leg 7, are pivotally connected at their first upper ends 17 to the underside of the deck support frame 3. The upper ends 17 of each stabilizer are connected to a fixed upper pivot 18 displaced from the leg upper moveable pivot 8 of the respective leg, and are pivotally connected at their second lower ends 19 to the respective pair of legs at a pair of respective lower stabilizer pivots 20.

A stabilizer cross-element 37 is pivotally connected between the pair of stabilizers 16 for each leg assembly. The respective stabilizer cross-element is connected to each respective stabilizer at a point 36 between its upper 17 and lower 19 ends.

An actuator-stabilizer yoke 21 is connected to each stabilizer cross-element at a point substantially mid-way along the stabilizer cross-element so that it is in the middle of the bed. The actuator-stabilizer yoke 21 is pivotally coupled to an end of an actuator 22 (which may be a hydraulic actuator, or a linear actuator such as model No LA27 actuators supplied by Linak U.S. Inc. located at 2200 Stanley Gault Parkway, Louisville Ky. 40223) which controllably extends and retracts an actuator rod 23 connected to the actuator-stabilizer yoke 21. Extension and retraction of the actuator rod 23 causes the respective stabilizer cross-element 37 and hence the pair of stabilizers 16 connected to that stabilizer cross-element 37 to move and thence the pair of legs 7 connected to that stabilizer 16 to rotate relative to the deck support frame 3 and thence raises or lowers the deck support frame 3 and the patient support surface arranged on that deck support frame. The actuators 22 may be controlled by either the patient or a care-giver. Control mechanisms for such actuators are well known and may be either a foot operated pedal, control panel on the side of the bed, remote control or other control mechanism. Suitable actuators are well known and are therefore not described in detail in this application. They may be hydraulic, electric or pneumatic. An example of hydraulic actuators controlling the height of a deck is described in EP 2 181 685 and WO 2004/021952.

Referring to FIG. 1, the deck support frame 3 is formed by three sides of a rectangle and comprises parallel side elements 24 connected at their head ends by a head frame element 25. In the described embodiment there is no foot frame element closing the rectangle other than the foot board (not shown) when that is attached to the foot board plates 34 (not shown) but one could be provided if appropriate. One of the known patient support deck arrangements such as that described in EP 2 181 685 and WO 2004/021952 may be secured to the patient support frame.

Figure 4:
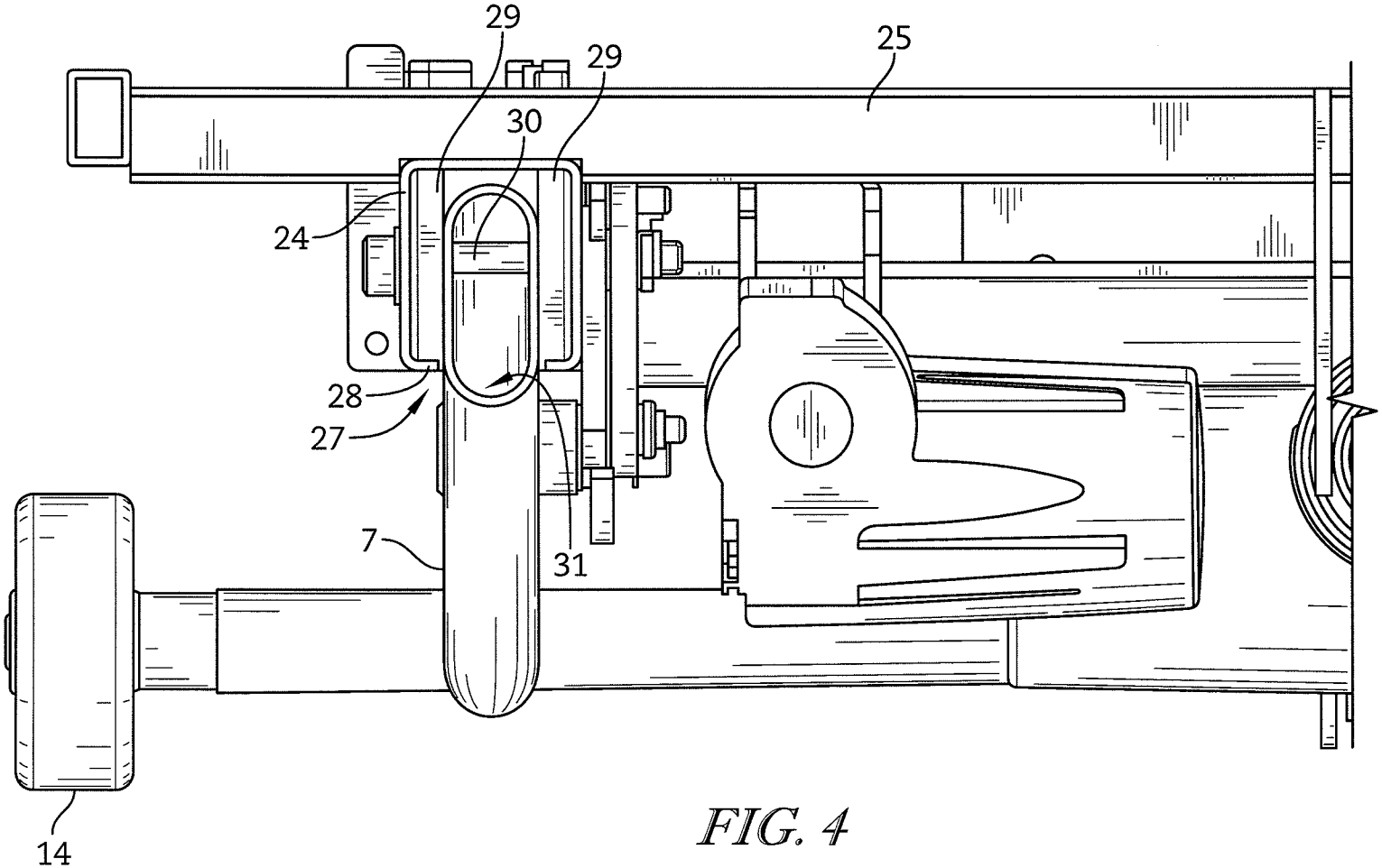
FIG. 4 is a detailed view of a section through the top of one of leg assemblies of the apparatus in FIG. 1.

As shown in, for example, FIG. 4, the side rail elements each comprise a hollow channel element open, along at least a portion of its length, on its lower side 27. The channel element is a modified inverted U-shaped channel in which a portion of the bottom edges 28 are lipped such that the sides of the channel extend partially across the bottom of the inverted U-shaped channel.

The upper end of each leg is connected to two rollers 29. The rollers 29 are supported on axles 30 running through the leg 7 and can rotate relative to the leg 7. The upper end 31 of each leg passes through the gap or space 32 in the bottom of the channel elements 24 defining the sides of the deck support frame. The rollers 29 each engage the inner surface of the channel element.

Referring to FIGS. 2 and 3, when the actuators 22 extend their respective rods 23 together to move the deck support frame 3 from a lowered position (see FIG. 3) to a raised position (see FIG. 2), the stabilizer element moves in direction E and pivots about its upper pivot. At the same time, the leg element pivots in direction F with its respective guide element moving in direction D1. As the guide element moves in direction D1 while the deck support surface is being raised, the respective set of rollers 29 roll relative to the respective channel element 24.

When the actuators 22 retract their respective rods 23 together to move the deck support surface from a raised position (FIG. 2) to a lowered position (FIG. 3), the stabilizer element moves in direction G and pivots about its upper pivot. At the same time, the leg element pivots in direction H with its respective guide element moving in direction D2. As the guide element moves in direction D2 while the deck support surface is being raised, the rollers roll relative to the channel element.

Movement of the legs 7 and associated rollers 29 brought about by extension of the actuator rod to raise the deck support frame, pushes the rollers against the inner surface of the top of the respective channel element 24 so the roller rolls against that inner top surface of the channel. When the deck support frame is lowered by retraction of the actuator rod, the weight of the deck support frame and the patient support surface and patient supported thereon presses the inner top surface of the channel 24 against the respective rollers so that again the rollers roll along that top inner surface.

The channel 24 is provided along a substantial part of its length with a lip portion 28 welded or otherwise attached to each of the bottom edges of the two sides of the channel element. This helps hold the rollers in place and, if the patient support deck is lifted manually or otherwise than using the actuators, pushes up against the bottom of the rollers such that they roll against the lipped bottom edges 28.

Moving the deck support frame into the Trendelenburg position or reverse Trendelenburg position is not illustrated in the Figs. However, it is achieved by having one of the leg assemblies in the raised position and the other in the lowered position and is otherwise the same as for lowering or raising the whole height of a substantially horizontal deck support frame. For the Trendelenburg position the foot end is raised to be about 15-30 degrees above the head end, whereas in the reverse Trendelenburg the head end is raised to be above the foot end.

In a one embodiment of the patient support apparatus according to the present disclosure, at least one of the castors and/or castor devices at each of the foot and head ends of the apparatus are provided with a brake assembly with a brake lever as described in, for example, U.S. Pat. No. 7,703,157 and arranged to be contacted and pressed down by the lower surface of the channel element to lock or brake the respective caster or caster device when the respective portion of the deck support frame is lowered.

Figure 5:
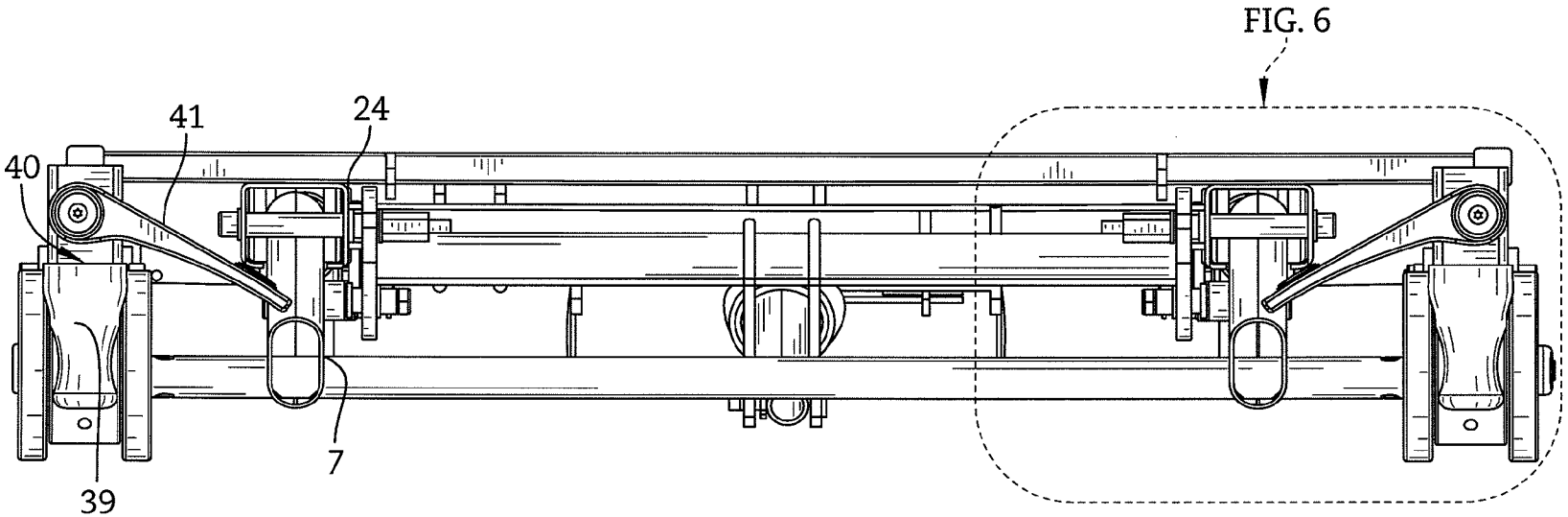
FIG. 5 is an end view of an alternative embodiment according to the present disclosure having a braking mechanism, in which the deck support frame is at its lowermost position and the brake engaged.
Figure 6:
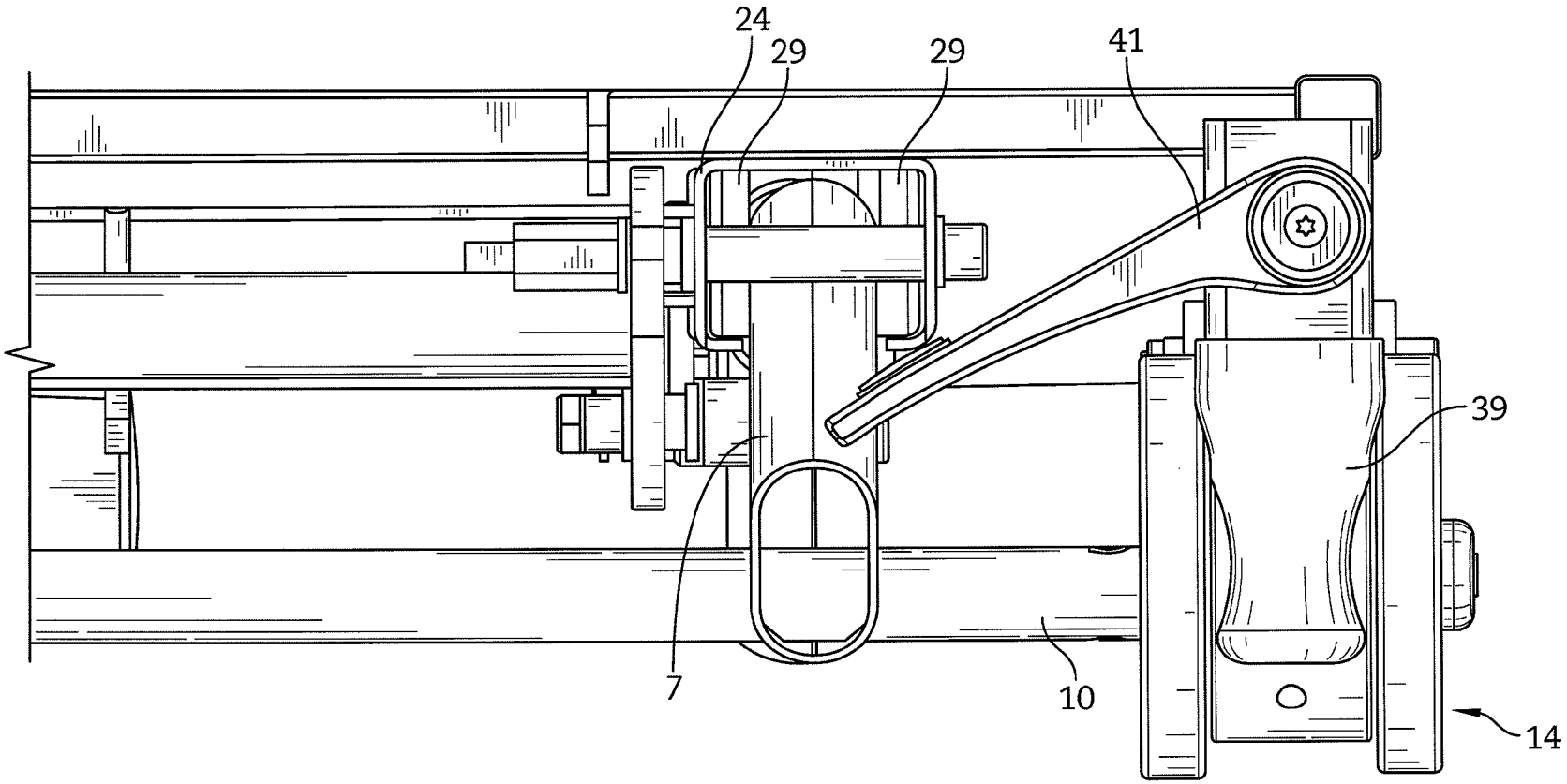
FIG. 6 is a detailed view of portion VI of FIG. 5.
Figure 7:
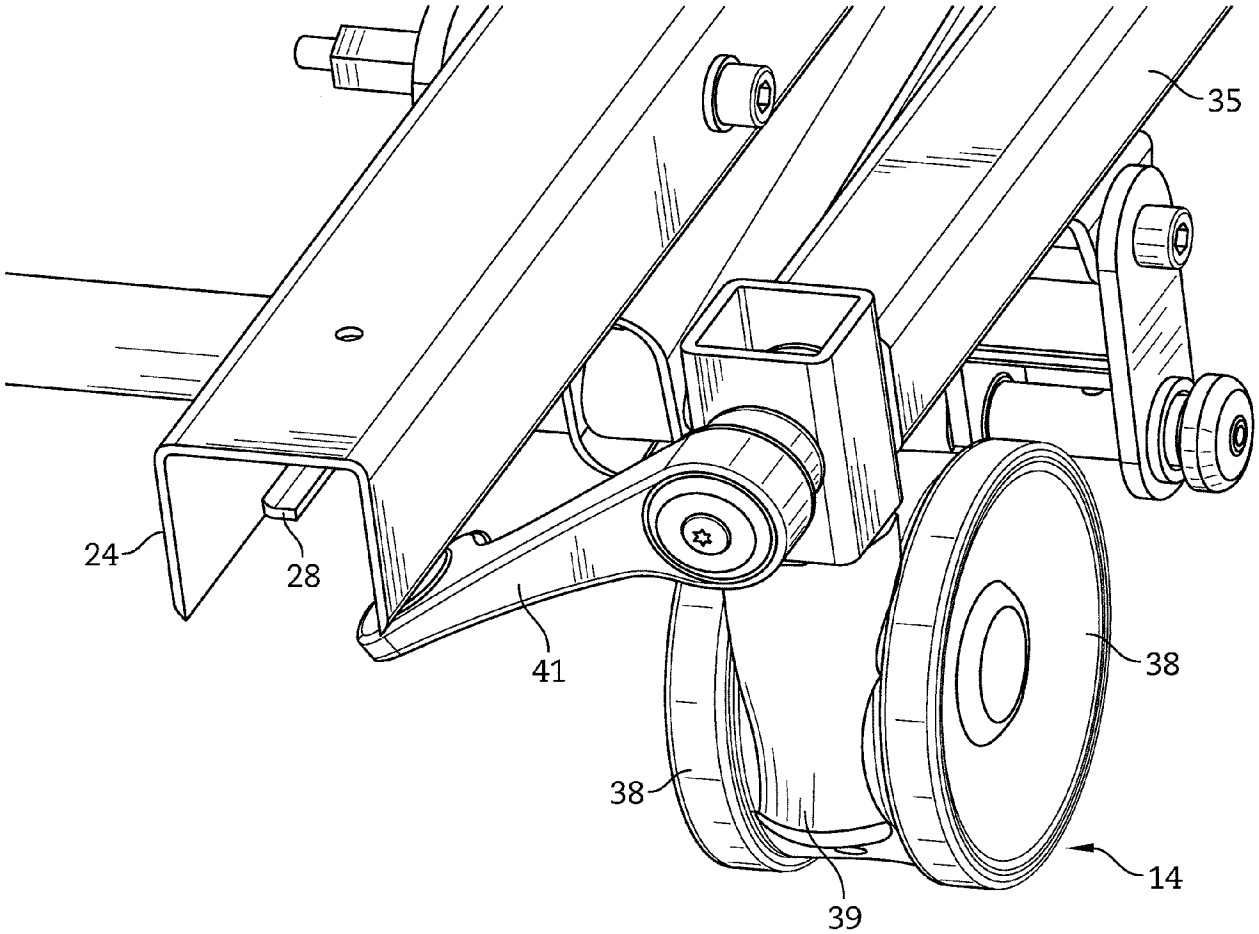
FIG. 7 is a perspective view corresponding to the view of FIG. 6.
Figure 8B:
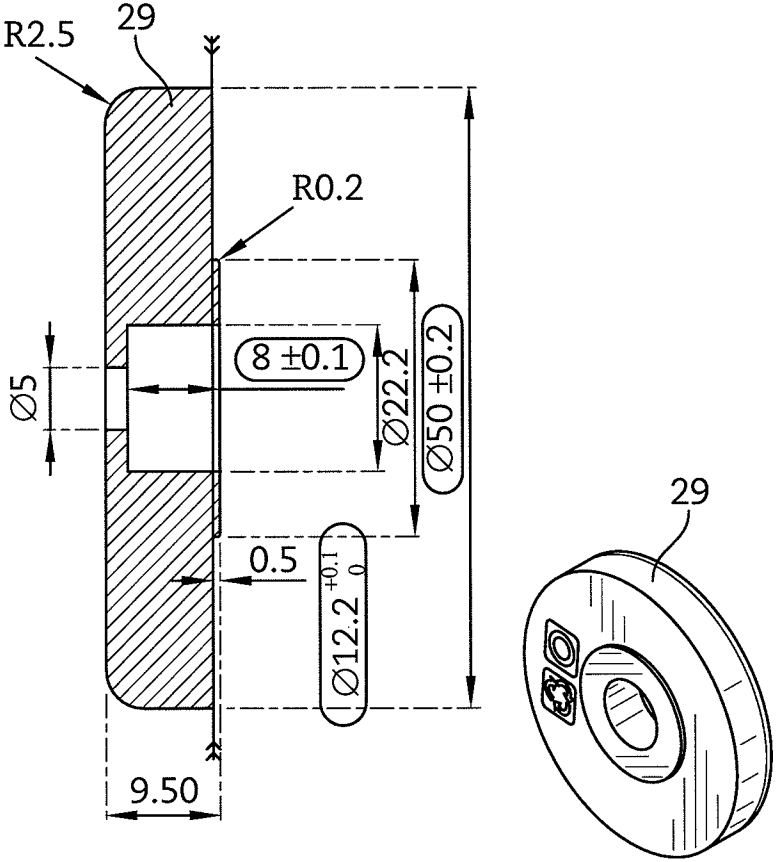
FIGS. 8*a* and 8*b* are diagrams setting out roller dimensions (in mm) for an embodiment according to the present disclosure.
Figure 8A:
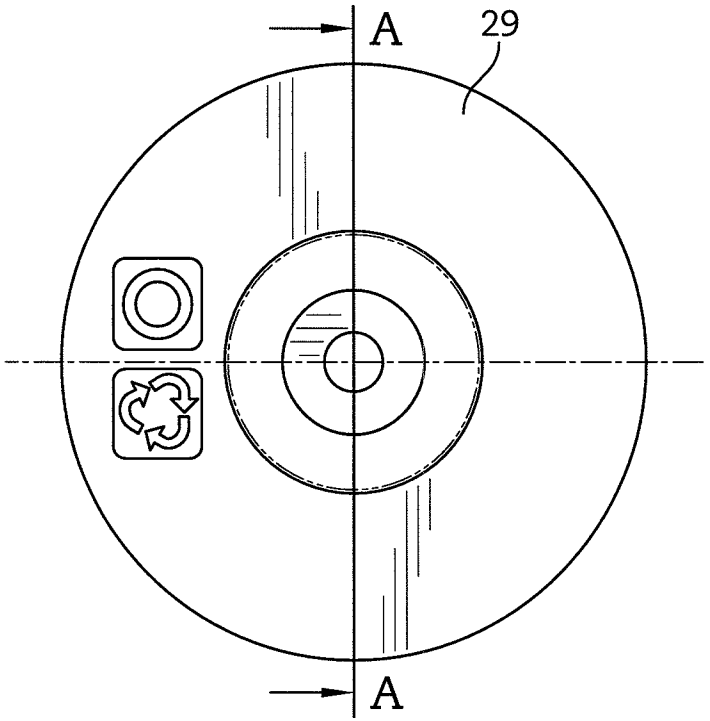
Figure 9:
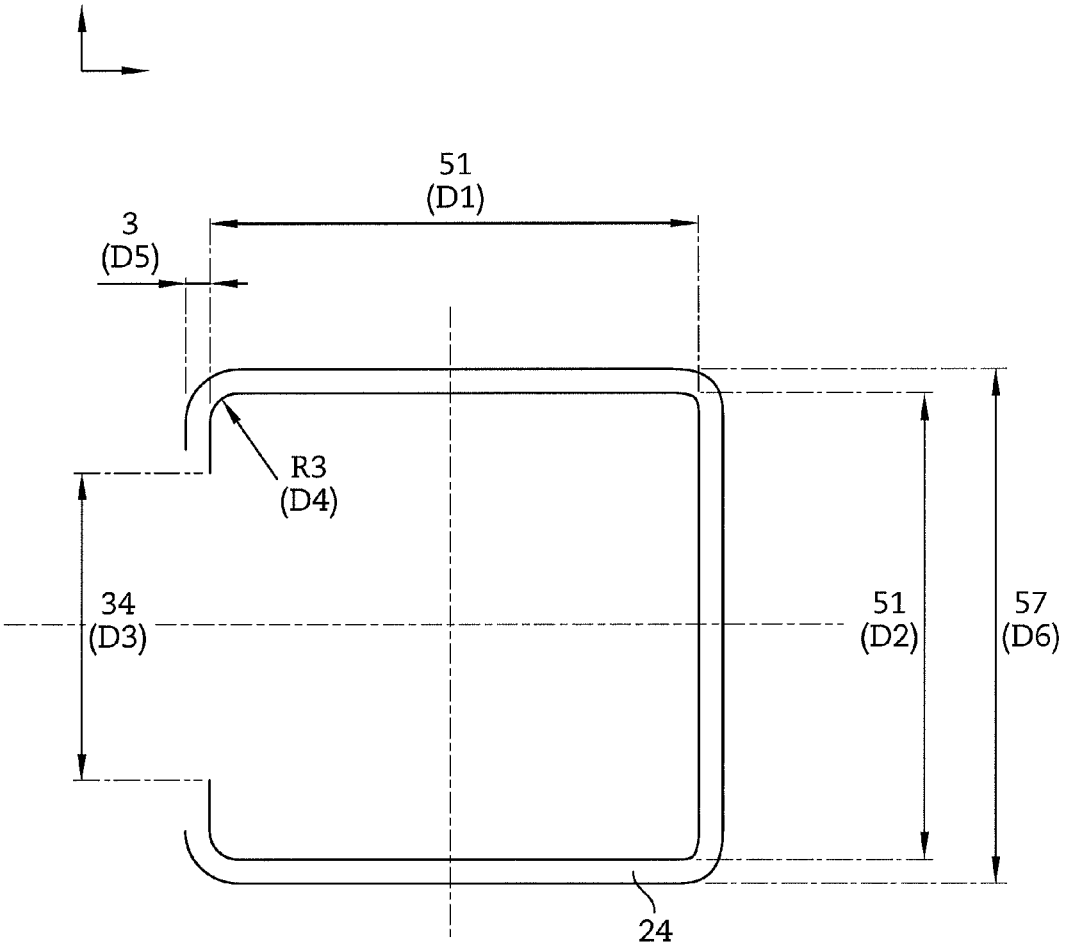
FIG. 9 is a diagram setting out dimensions (in mm) for a channel element suitable for use with the roller of FIGS. 8*a* and 8*b*.
Figure 10:
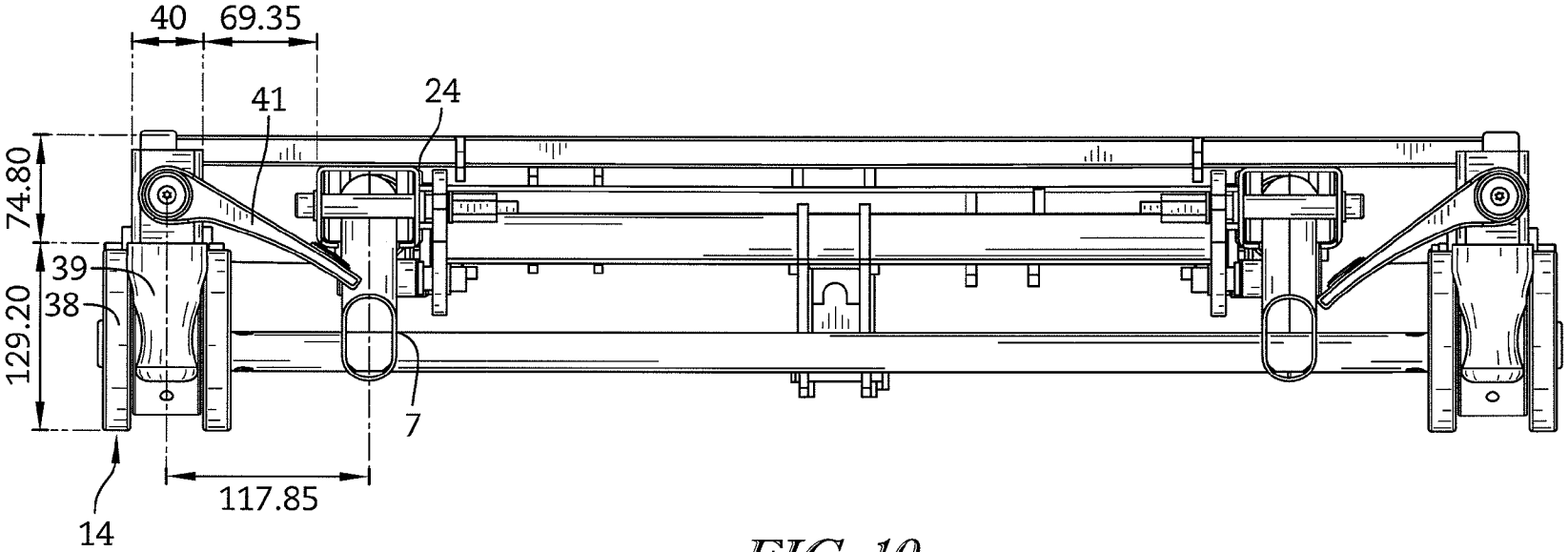
FIG. 10 is a diagram setting out dimensions (in mm) for a suitable brake lever and channel element.

Each of the castors includes a braking mechanism. FIGS. 5 to 7 show how a braking mechanism of the type used in castors of the type supplied by Tente as parts reference 5944 USC125 R36 may be incorporated in an embodiment according to the present disclosure. In such castors, the castor wheels 38 are braked when a pliable braking element 39 is squeezed down by a braking surface 40 so that the sides of the braking element contact and push against the sides of the castor wheels. An alternative braking element is shown in U.S. Pat. No. 7,703,157 in which braking is by means of a floor engaging element which is pushed into contact with the floor when the braking surface is ousted downwards. Any castor with an actuator mechanism operable by being pressed down or contacted may be used.

The braking surface 40 at the foot ends of the bed is pushed downward by the action of a braking lever 41 which may be actuated by, for example, the foot of a care giver on, as is shown in FIGS. 5 to 7, by contact with the underside of the channel element 24 as the bed is lowered to the lowermost position. The use of a guide element 8 which moves inside a channel 24 allows one to position the longitudinal channel 24 closer to the edges of the bed than is possible with the previous arrangements with a guide element on the outside of a channel. This means that the channel or longitudinal rod 24 can be positioned so it moves in a place sufficiently close to the wheels to itself directly engage the brake lever 41.

The brake surfaces (not shown) of the head end castors are connected to a respective foot end braking levers 41 by a rod element running inside each of the lower rail elements 35. Movement of the braking lever 41 causes the rod to rotate and hence push the braking surfaces associated with the head end castors to move and hence brake or release the head end castors.

Although certain illustrative embodiments have been described in detail above, variations and modifications exist within the scope and spirit of this disclosure as described and as defined in the following claims.

The invention claimed is:

1. A person support apparatus comprising:

a person support frame for supporting a person support deck, the person support frame having two sides extending between a head end and a foot end; and a support assembly for supporting the person support frame and moving it relative to a floor surface, wherein the support assembly comprises at least one leg assembly pivotally coupled at a first upper end portion to the person support frame and coupled at its second lower end portion to floor engaging means, and an actuator element operable to move the leg assembly and thereby move the person support frame relative to the floor, wherein at least one of the sides of the person support frame comprises an inverted substantially U-shaped channel element having a substantially continuous upper surface, two substantially continuous side surfaces connected at their top edges to the upper surface, and a downward facing opening between the bottom edges of the two side surfaces, and the first upper end portion of the leg assembly includes a guide or follower element arranged to contact and run along an inner surface of the channel element.

2. The person support apparatus of claim 1, wherein the guide element comprises a roller assembly arranged to run inside the channel element and engage and run along a channel between the bottom of the upper surface of the channel element and the bottom of the channel element.

3. The person support apparatus of claim 2, wherein the roller assembly is supported on a surface of the upper end portion of the leg assembly and an upper portion of the leg assembly extends through the bottom open side of the channel element and into the channel element.

4. The person support apparatus of claim 1, wherein the lower edge of at least one of the side surfaces has a lipped portion projecting partially across the bottom of the channel to partially close the open bottom side of the channel element.

5. The person support apparatus of claim 4, wherein the lower edges of both side surfaces include lipped portions projecting partially across the open bottom side of the channel element.

6. The person support apparatus of claim 5, wherein the guide element comprises a pair of roller assemblies that are supported on the leg assembly with one roller on a first side of the leg assembly and the other on an opposite side, the rollers each being arranged to run inside the channel element and engage and run along the channel between the top surface of the opposing lipped portions and the bottom of the upper surface.

7. The person support apparatus of claim 1, wherein the floor engaging means includes a fixing brake for fixing the position of the floor engaging element relative to a floor, the fixing brake comprising an actuator adapted to be moved between a braking position and a release position and wherein the actuator is arranged to be engaged by a lower surface of the channel element as the respective leg assembly reaches its lowermost position and thereby automatically brake the floor engaging means as the leg assembly reaches its lowermost position.

8. The person support apparatus of claim 7, wherein the floor engaging means is a castor device.

9. The person support apparatus of claim 7, comprising floor engaging means at each of the foot and head ends of the apparatus and wherein the actuator comprises a lever at the foot end of the apparatus, the lever being coupled to the floor engaging means on both the foot end leg assembly and the head end assembly so as to automatically brake floor engaging means on both the foot end and head end as the leg assembly reaches its lowermost assembly.

10. The person support apparatus of claim 9, further comprising at least one lower longitudinal side frame element coupled to a lower portion of the leg assembly and including floor engaging means at its foot and head ends, and wherein the lever at the foot end is coupled to the head end floor engaging means by a rotatable rod extending along or inside the lower longitudinal side frame element.

11. A person support apparatus comprising:

a person support frame for supporting a person support deck, the person support frame having two sides extending between a head end and a foot end; and a support assembly for supporting the person support frame and moving it relative to a floor surface, wherein the support assembly comprises at least one leg assembly pivotally coupled at a first upper end portion to the person support frame and coupled at its second lower end portion to floor engaging means, and an actuator element operable to move the leg assembly and thereby move the person support frame relative to the floor, wherein the upper end portion of the leg assembly is configured to extend into a channel follower guide element, and the upper end portion of the leg assembly includes a roller assembly configured, in use, to run along at least one interior surface of a channel follower guide element as the person support frame moves relative to the floor, the channel follower guide element comprising an inverted substantially U-shaped channel element having a substantially continuous upper surface, two substantially continuous side surfaces connected at their top edges to the upper surface, and a downward facing opening between the bottom edges of the two side surfaces.

* * * * *